US009624682B2

(12) United States Patent
Jamison

(10) Patent No.: US 9,624,682 B2
(45) Date of Patent: Apr. 18, 2017

(54) UNIFIED MULTIPLE USE STADIUM STRUCTURE

(76) Inventor: John Paul Jamison, Poolesville, MD (US)

( * ) Notice: Subject to any disclaimer, the term of this patent is extended or adjusted under 35 U.S.C. 154(b) by 701 days.

(21) Appl. No.: 12/713,858

(22) Filed: Feb. 26, 2010

(65) Prior Publication Data

US 2010/0212232 A1 Aug. 26, 2010

Related U.S. Application Data

(60) Provisional application No. 61/155,533, filed on Feb. 26, 2009, provisional application No. 61/234,310, filed on Aug. 16, 2009.

(51) Int. Cl.
*E04H 3/12* (2006.01)
*E04H 3/14* (2006.01)

(52) U.S. Cl.
CPC ..... *E04H 3/14* (2013.01)

(58) Field of Classification Search
USPC ..... 52/6–9; 472/85, 92
See application file for complete search history.

(56) References Cited

U.S. PATENT DOCUMENTS 2,587,159 A * 2/1952 Holmes ..... 52/9
2,766,046 A 10/1956 Skrainka
2,831,217 A 4/1958 Lambardo
2,836,419 A * 5/1958 White et al. ..... 472/87
3,002,233 A 10/1961 Gyo
3,241,270 A 3/1966 Newman
4,379,378 A * 4/1983 McMahan ..... 52/9
4,688,357 A * 8/1987 Deaton ..... 52/9
4,982,930 A * 1/1991 Stewart ..... 254/124
5,014,983 A * 5/1991 Saunders ..... 473/483
5,186,119 A * 2/1993 Hlavin ..... 116/222
5,188,567 A * 2/1993 Volkov ..... 472/85
5,319,895 A 6/1994 Ray
5,365,704 A 11/1994 Ray
5,794,383 A * 8/1998 Labinski ..... 52/9
(Continued)

OTHER PUBLICATIONS

Map of Indianapolis Motor Speedway, in public use since 1909.*
(Continued)

*Primary Examiner* — Brian Mattei
(74) *Attorney, Agent, or Firm* — Symbus Law Group, LLC; Clifford D. Hyra

(57) ABSTRACT

A unified multiple-use stadium has multiple fields or other areas for putting on various types of sporting events or other performances sequentially or simultaneously. A racetrack surrounds the fields or other areas. A unifying structure in the center of the stadium allows for simultaneous viewing of different areas and sporting events. Walkways extend from the unifying structure and between bleachers for the different fields or other areas. A drag strip and return area extend in one direction from the unifying structure. Exterior bleachers surround the racetrack. The types of fields and areas can vary, but can include a grass field, a dirt field, a sand and water area, and a concrete pad. There may be additional areas for extending these areas. The interior bleachers are transforming bleachers that can be lowered into the ground or raised to tapered or fully extended positions to accommodate different types of sporting events.

4 Claims, 12 Drawing Sheets

(56) References Cited

U.S. PATENT DOCUMENTS

| | | | | |
|---|---|---|---|---|
| 5,921,032 | A * | 7/1999 | Labinski | 52/9 |
| 5,927,022 | A | 7/1999 | Hirakawa | |
| 5,979,879 | A * | 11/1999 | Asplin | 254/133 R |
| 6,155,937 | A * | 12/2000 | Alter | 473/469 |
| 6,168,532 | B1 | 1/2001 | McCaffrey | |
| 6,202,356 | B1 | 3/2001 | Hock | |
| 6,324,790 | B1 * | 12/2001 | Victor et al. | 52/9 |
| 6,591,554 | B2 * | 7/2003 | Kumer, Jr. | 52/9 |
| 6,832,452 | B1 | 12/2004 | Simens | |
| 6,915,610 | B2 | 7/2005 | Stark, III | |
| 6,931,808 | B2 * | 8/2005 | Hamar | 52/403.1 |
| 7,014,578 | B1 * | 3/2006 | Brodeur | 473/477 |
| 2005/0021364 | A1 * | 1/2005 | Nakfoor | 705/1 |
| 2005/0075179 | A1 | 4/2005 | Marcinkowska | |
| 2005/0107172 | A1 | 5/2005 | Morell | |
| 2006/0105847 | A1 * | 5/2006 | Stroppiana | 472/85 |
| 2008/0268968 | A1 | 10/2008 | Back | |

OTHER PUBLICATIONS

Map of Route 66 Raceway in Illinois, in public use since 1998.*
Presentation given in Aug. 2008 for the Umhlathuze Multi-Purpose Sport Stadium in Uthungulu, South Africa.*
Web archived page of the CN Tower from the wayback machine, Feb. 18, 2007.*
Pictures and description of the Pagoda at Indianapolis Motor Speedway found at: http://www.indianapolismotorspeedway.com/facility/35548-Pagoda/ The pagoda was originally built in 1913 and built in its current configuration in 2000.*
3D racetrack viewing map of the Indianapolis Motor Speedway found at: http://seats3d.com/racetracks/indianapolis_motor_speedway/1/#/level_1/ Originally constructed in 1909 with the last of the major renovations made in 2000.*
Map of Laguna Seca Raceway dated Jan. 8, 2008 found at: http://web.archive.org/web/20080118083231/http://www.corvetteracing.com/tracks/trk_img/laguna/seca_tracks.shtml.*
Gus Macker 3-on-3 basketball tournament photos found at and dated that 2014 is the 12th year these games were hosted: http://www.macker.com/macker-tournament/2014-gus-macker-tour/262-morris-il.html.*
Article about scissor lifts for sports dated Nov. 2010, but dates scissor lifts in sports to long before that, at least 2000: http://www.athleticbusiness.com/spectator-safety/notre-dame-s-fatal-scissor-lift-accident-shakes-collegiate-sports-video-community.html.*
photos of pagoda dated May 2008 found at: http://www.flickr.com/photos/casadeyork/2525054045/.*
Images of fence surrounding Indianapolis Motor Speedway.*
Description of Indiapolis Motor Speedway by the local Hilton hotel found on the wayback machine dated Sep. 2010 and found at: http://web.archive.org/web/20100924143702/http://indianapolishilton.com/indy_ims.html.*
Aerial view of Pagoda.*
Annotated 3d map of Indy racetrack and annotated 3d map of Indy showing the viewing mounds with photo.*

* cited by examiner

UNIFIED MULTIPLE USE STADIUM STRUCTURE

This application claims the benefit of U.S. Provisional Application No. 61/155,533, filed Feb. 26, 2009, and No. 61/234,310, filed Aug. 16, 2009, which are hereby incorporated by reference in their entireties.

FIELDS OF THE INVENTION

The invention relates to sporting fields, arenas, stadiums, theaters, and raceways.

BACKGROUND OF THE INVENTION

Today's sporting fields, arenas, stadiums, and raceways, are deficient in many different ways. One of the main ways they are deficient is in that they do not accommodate as many sporting events as possible. Another way that they are deficient is that they do not offer the ability to see different sports at once or multiple sports at a single location. They limit the amount of money that can be generated. They do not attract the attention that having multiple events will generate. Many events and especially races are seasonal and do not allow for use of the venue during event off-seasons. Another way they are deficient is in that in order to change venues at today's sporting event locations, it takes time. This causes considerable downtime, which equals money and man hours in order to prepare for the next event. Another way they are deficient is that they do not have a center unifying structure that allows for multiple event viewing at one time.

The current venues are not able to accommodate as many sports as possible. This is deficient in many different ways. First, other venues have to accommodate with different facilities, thus causing competition between venues. This causes money loss for both parties involved. Second, it draws attention away from a venue thus causing more money to be spent on advertising. If there were more than one event being advertised for one location marketing costs would drop considerably, thus generating more profit. Third, having many different sports in one venue would cause greater exposure to other sports. This would cause people to come back more often, or buy another ticket and stay longer.

At current sporting venues spectators are not able to watch multiple live sporting events at once. This is a deficient in different ways. First, for a spectator to be able to watch multiple events live will increase their enjoyment and their overall experience. It will cause them to have a greater sense of satisfaction for purchasing a ticket. A second deficiency due to this would be that of money generated. Being able to offer the viewing of multiple events as opposed to just one would greatly increase the venue's appeal. Multiple live sporting events have more appeal than a single sporting event, this will cause greater appeal for the venue itself and thus lower marketing costs and increase sales. Today's stadiums aren't as profitable as they need to be.

Current sporting venues are deficient in optimal structure usage. Many events only require a structure usage due to their seasonability. This is extremely deficient in terms of profit. The more the structure is used, the more money can be generated. By only accommodating a select few events, today's structures are left with a gap that must be must be filled, or lose potential income. This is a grave deficit. A stadium needs to be able to have events consistently, and must also be able to accommodate different events without downtime. This will also help by keeping an audience in a structure once there. Another grave deficiency is that of not being able to buy tickets to multiple events at a single venue. If there were multiple events at once in a stadium, an attendee could buy several tickets, or a single electronic ticket. This would greatly increase a stadium's potential income. By not expanding to a larger structure, income quickly plunges from its potential.

Another current sporting venue deficiency relates to structure downtime. Structure downtime as discussed herein is the time lapse that current structures have changing their venues to accommodate different sports and their necessary requirements. This downtime is deficient in different ways. The first would be that of a loss of audience. When today's structures are filled with attendees, they lack the ability to showcase different events back to back. This causes much money lost, in the fact that once an attendee is at a structure, it is much easier to go to another event. Once they are in the structure, they are more likely to stay.

The next deficiency in today's structures is structure setup time. Today's structures take time to set up for an event, and thus render today's structures incapacitated, and unable to generate income. These structures are losing a lot of money by having to set up for an event and not having other events simultaneously. Another deficiency is that of cost of setup. It costs a stadium a lot of money and man hours to change a structure to accommodate another event. This is deficient in that there should be different venues to accommodate different events, thus greatly reducing the time that the structure is left incapacitated.

Another current sporting venue deficiency is that of unification. Today's structures do not unify multiple varying events. They separate instead of unify. For instance M&T Bank Stadium and Camden Yards are next door to each other yet not together as one. By unifying the stadiums, more tickets to events will be sold and marketing costs will drop, thus increasing profits. Another deficiency that today's structures have is that of a unifying structure. A simple unifying structure between venues will signal unification. This structure would be the more expensive seating and thus generate higher revenues. This structure will be unique in that it that is in the center of all venues and accommodates attendees with views of all events at once. Another reason for unifying, is for a greater presence which would lower marketing costs. Unification of events is a key deficiency in the current event structures.

Needs exist for improved venues for sporting events and other performances and gatherings.

SUMMARY

A new multiple use stadium overcomes the deficiencies of previous venues. The stadium in one embodiment is in the shape of a square cut into a cross with stands surrounding it. In that embodiment, the stadium may include four different fields, racetracks, and a unifying structure in the center of the stadium. The fields may be primarily grass, dirt, sand and water, and a unique concrete pad. However, the type of field can vary and for instance there could be two dirt fields and no grass field if desired. In one embodiment, the racetracks include a drag strip, a dirt track, and an outer track with the potential for an event such as NASCAR, as well as an Indy track with turns much like a Formula One-Indy track. In one embodiment, the unifying structure is set in the center of the fields, has optimal views of all events, and rises above the fields, as well as the inner bleachers.

These and further and other objects and features of the invention are apparent in the disclosure, which includes the above and ongoing written specification, with the drawings.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art.

DETAILED DESCRIPTION

Figure 1:
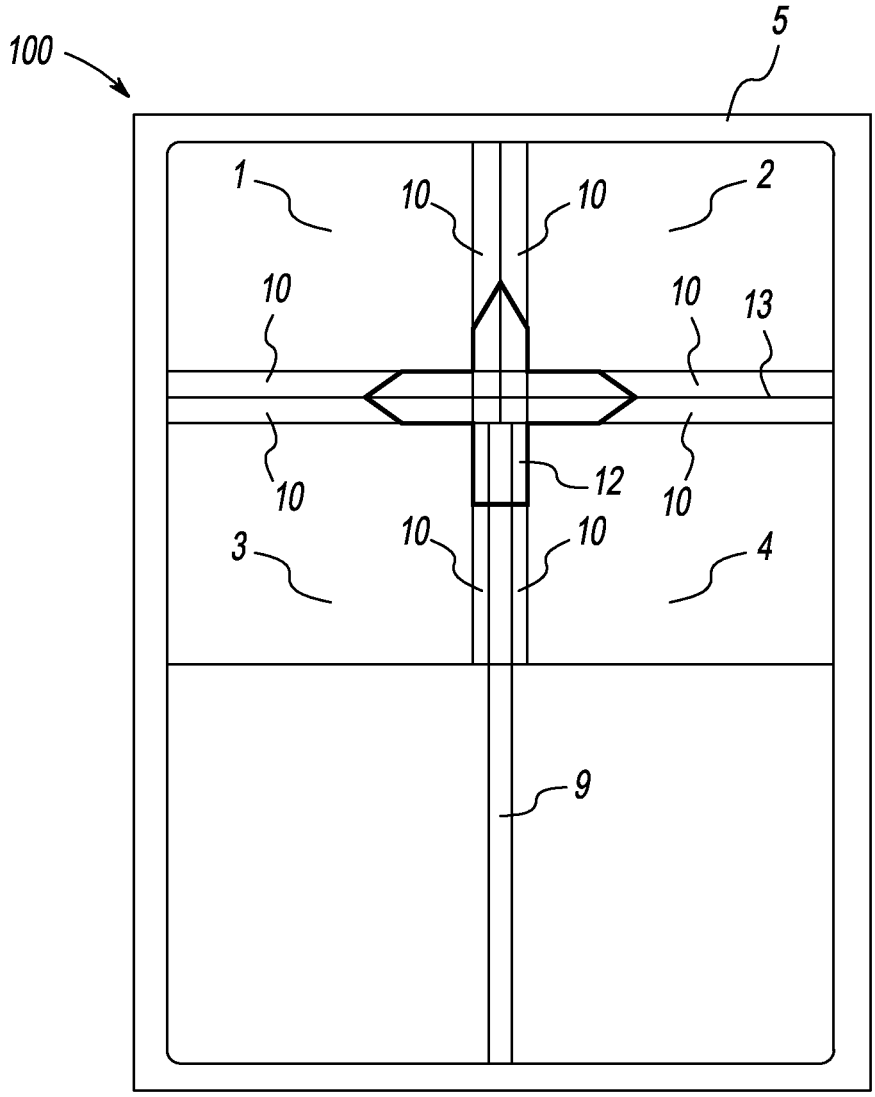
FIG. 1 is a closeup diagram of a unified stadium structure.

A unified multiple use stadium structure will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The figures are not to scale. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

Figure 2:
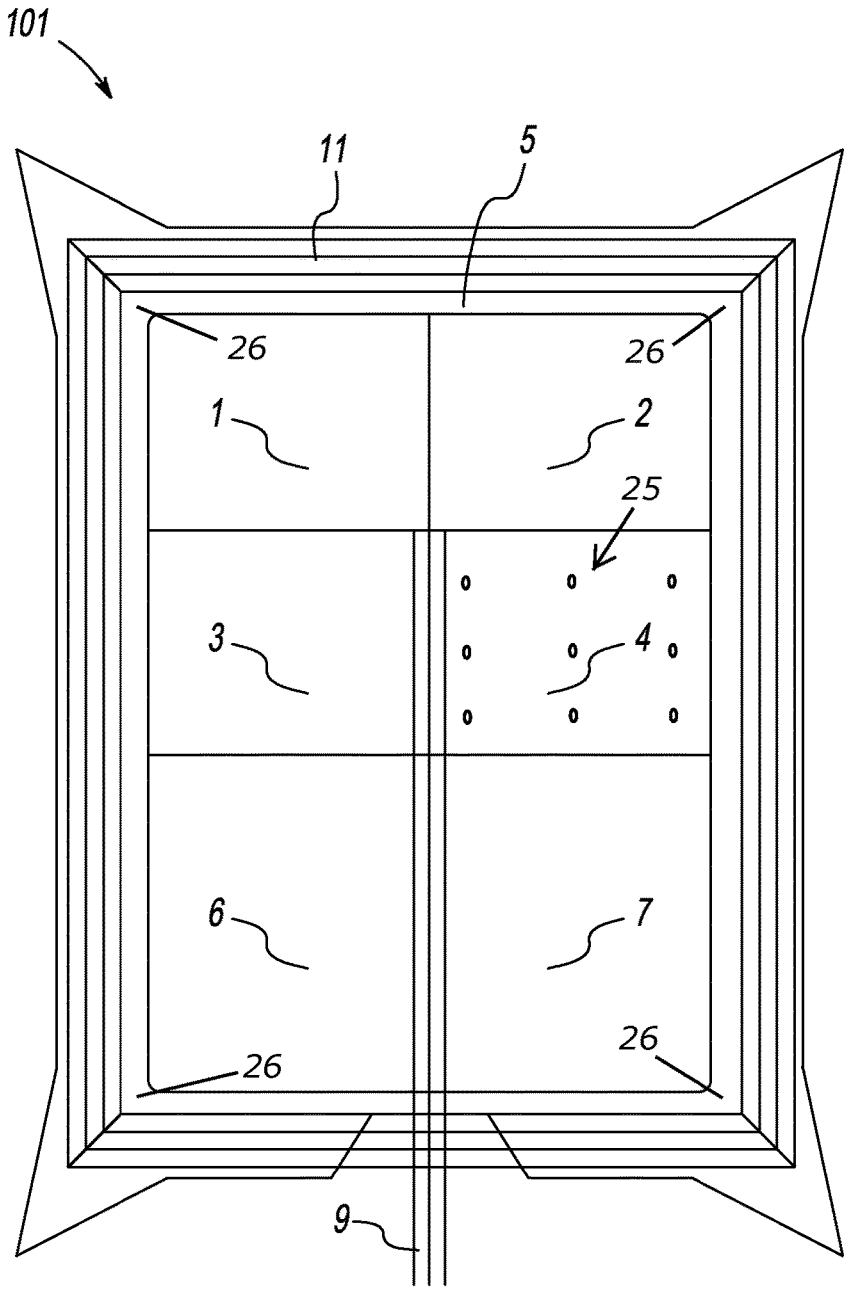
FIG. 2 is a diagram of an overview of a stadium.
Figure 3:
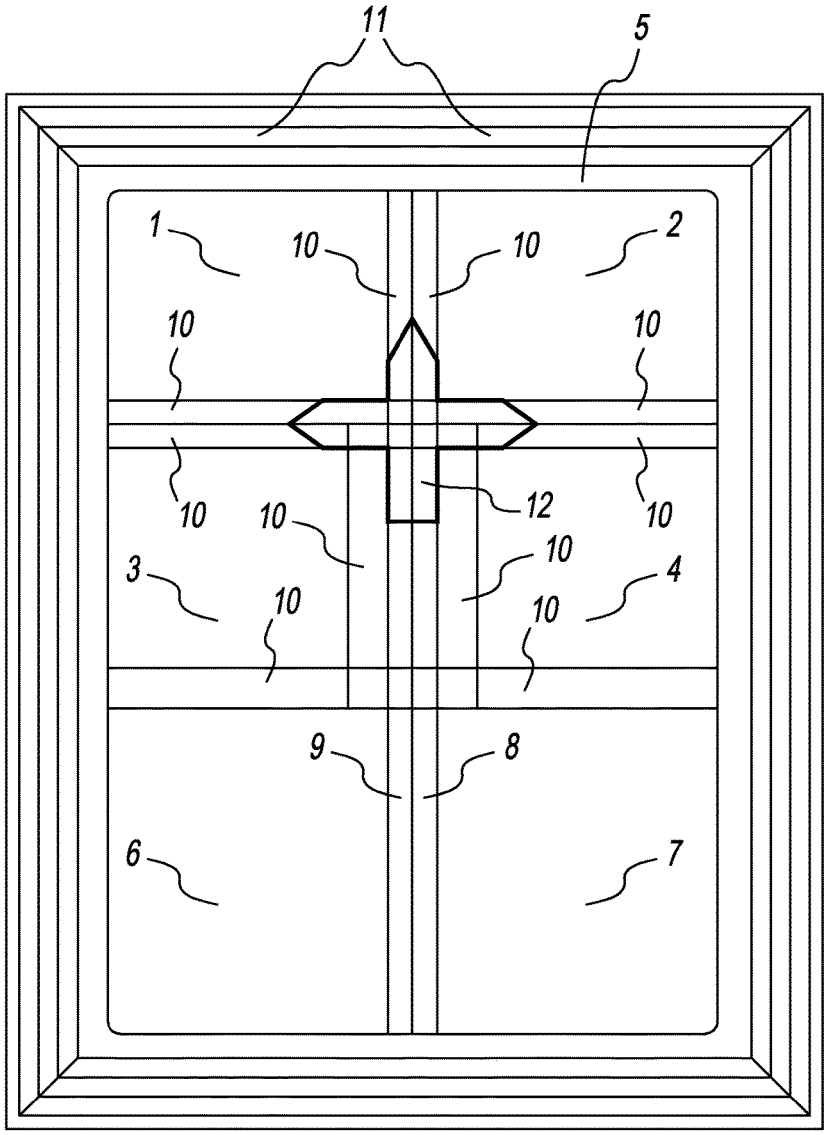
FIG. 3 is a diagram of a stadium close-up.
Figure 4:
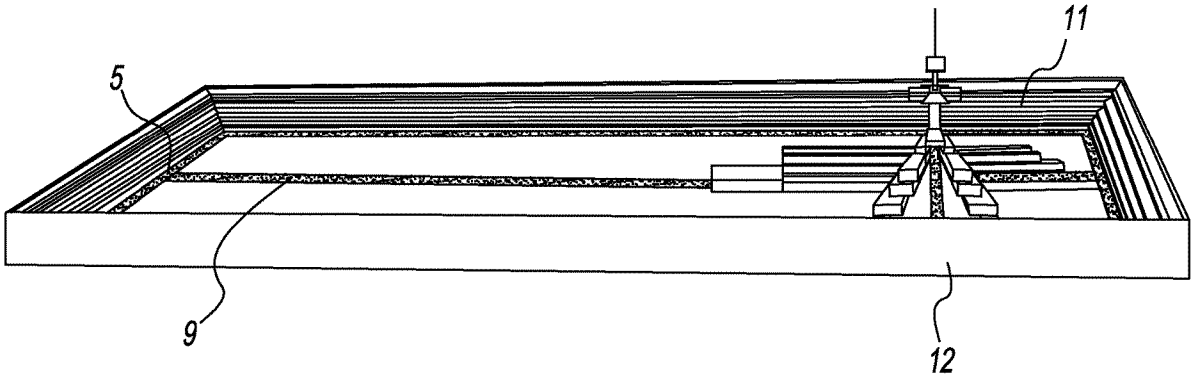
FIGS. 4-12 are photographs of a model of one embodiment of a multiple use stadium structure.
Figure 5:
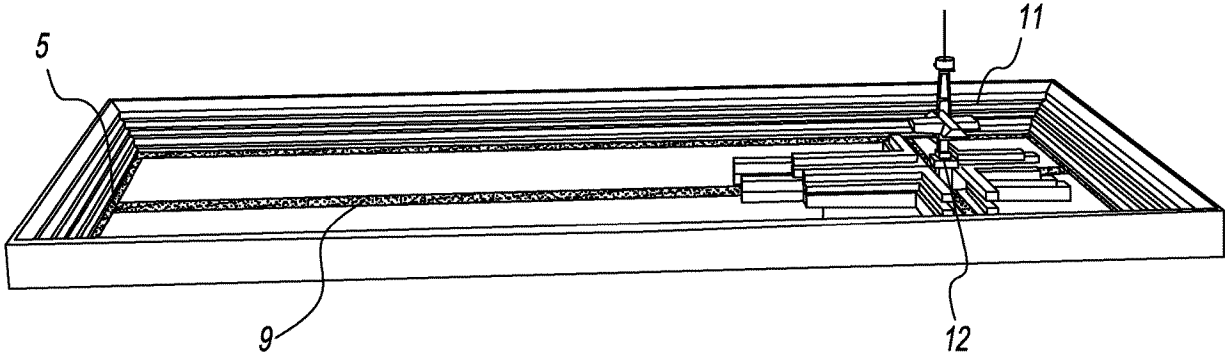
Figure 6:
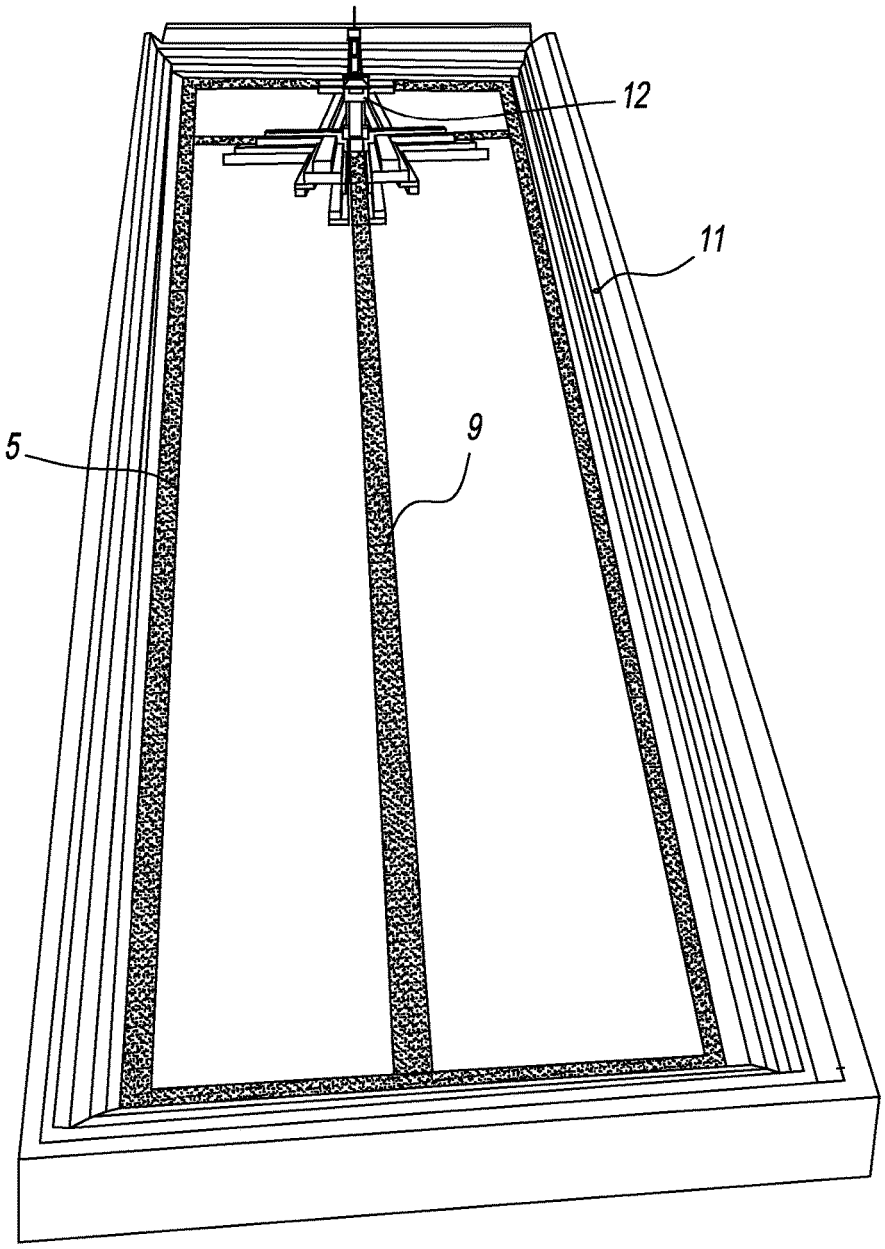
Figure 7:
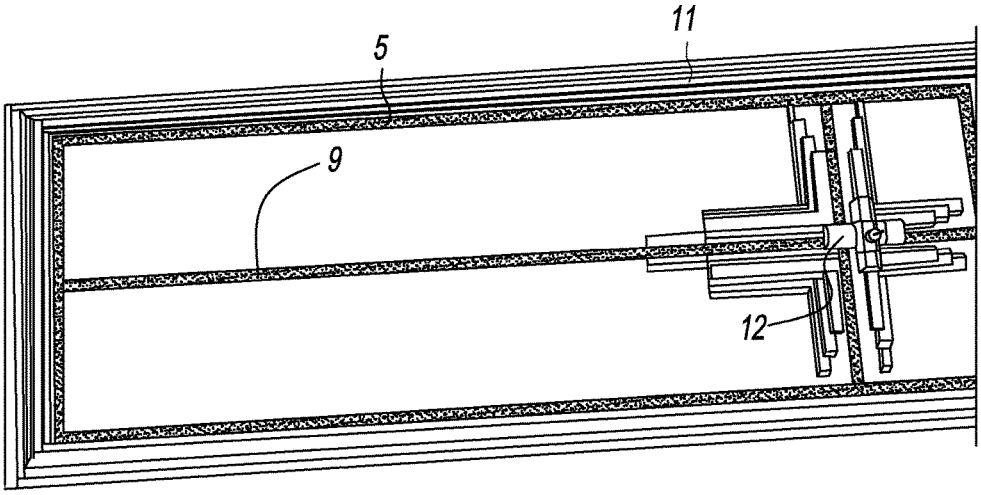
Figure 8:
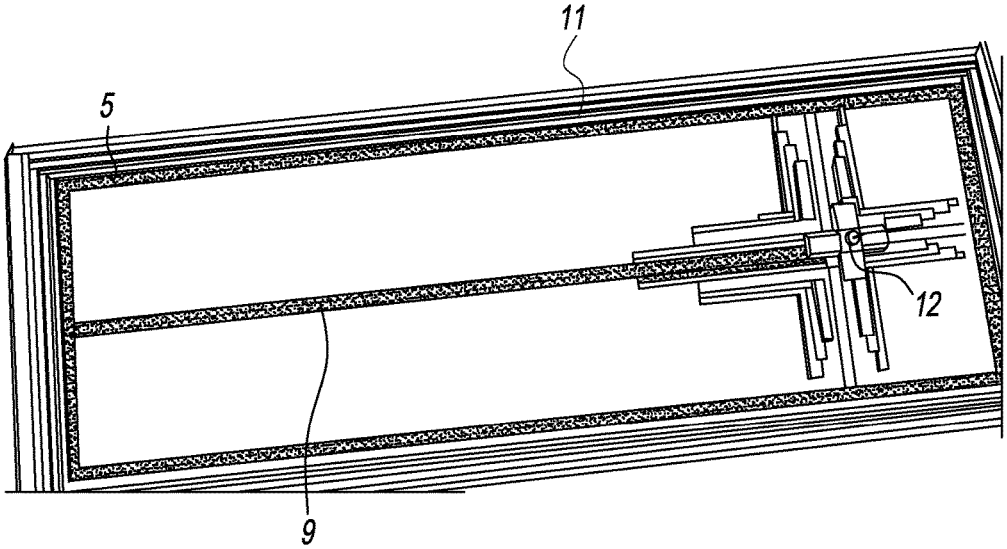
Figure 9:
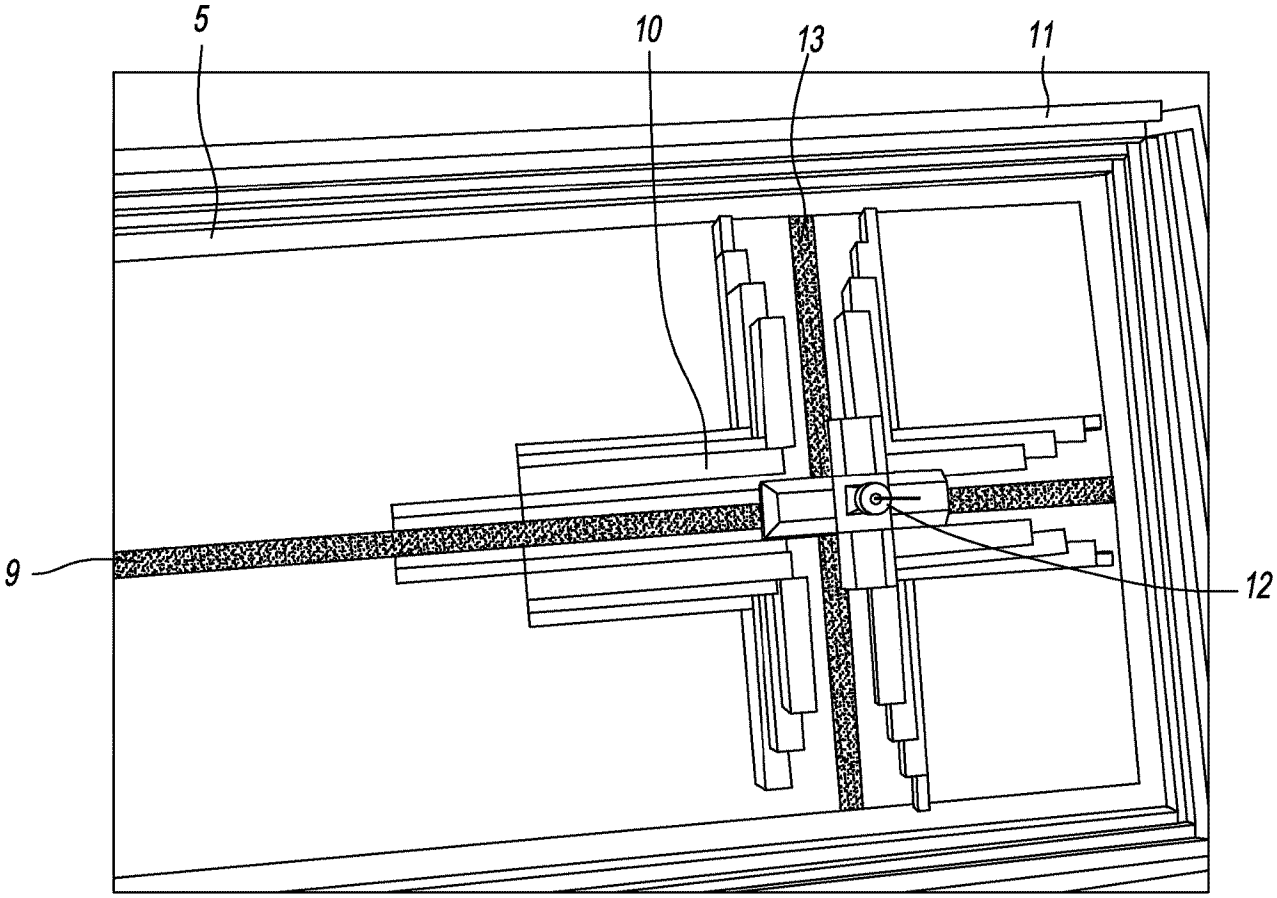
Figure 10:
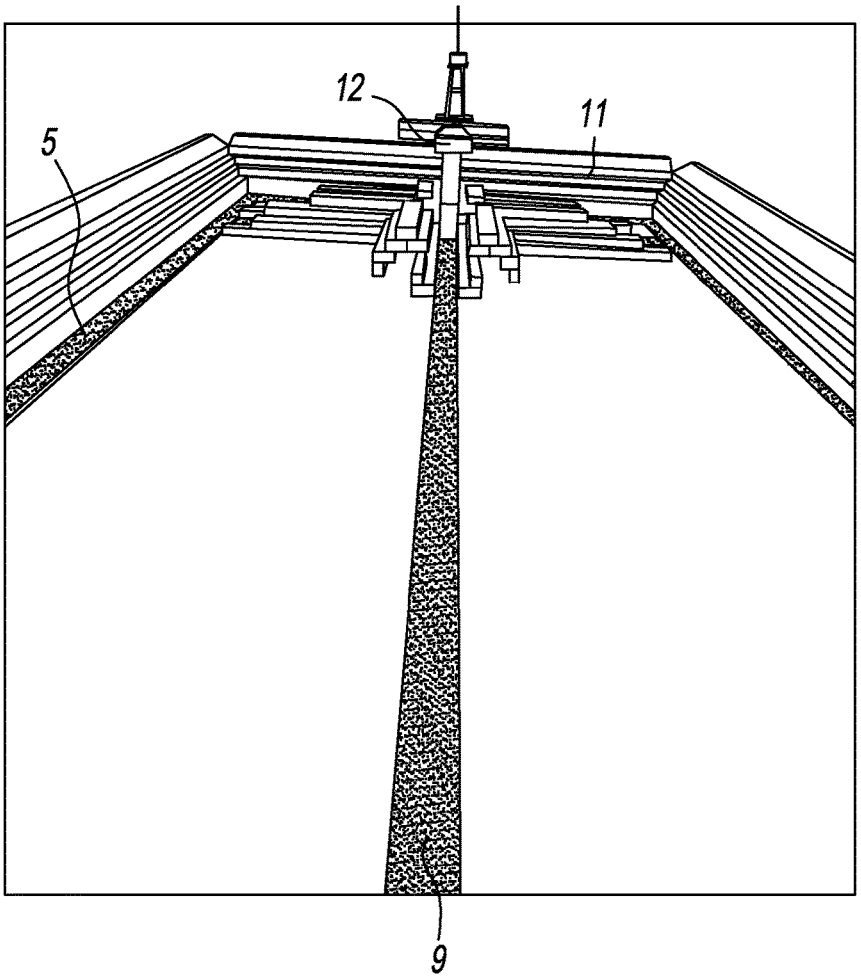
Figure 11:
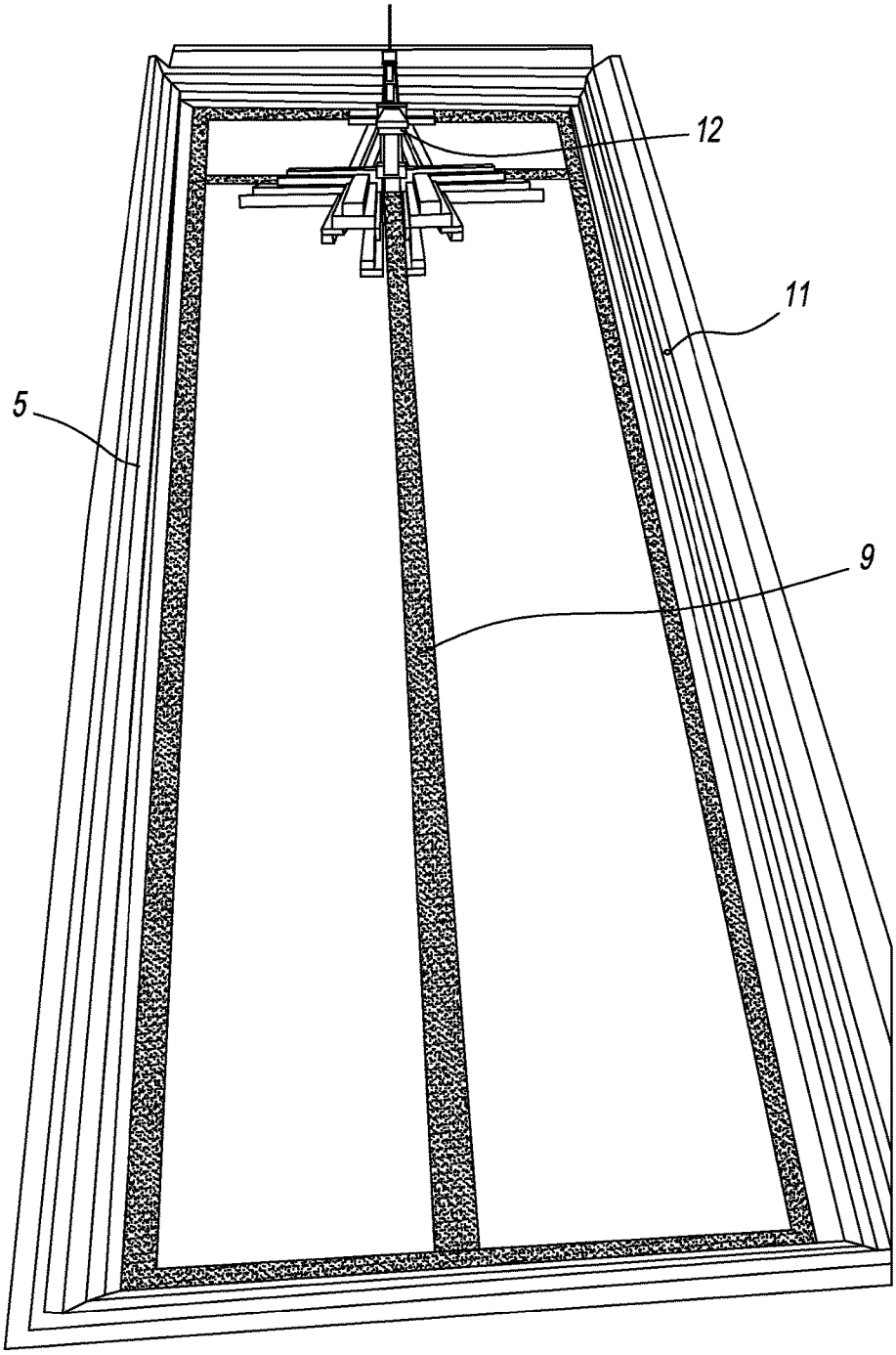
Figure 12:
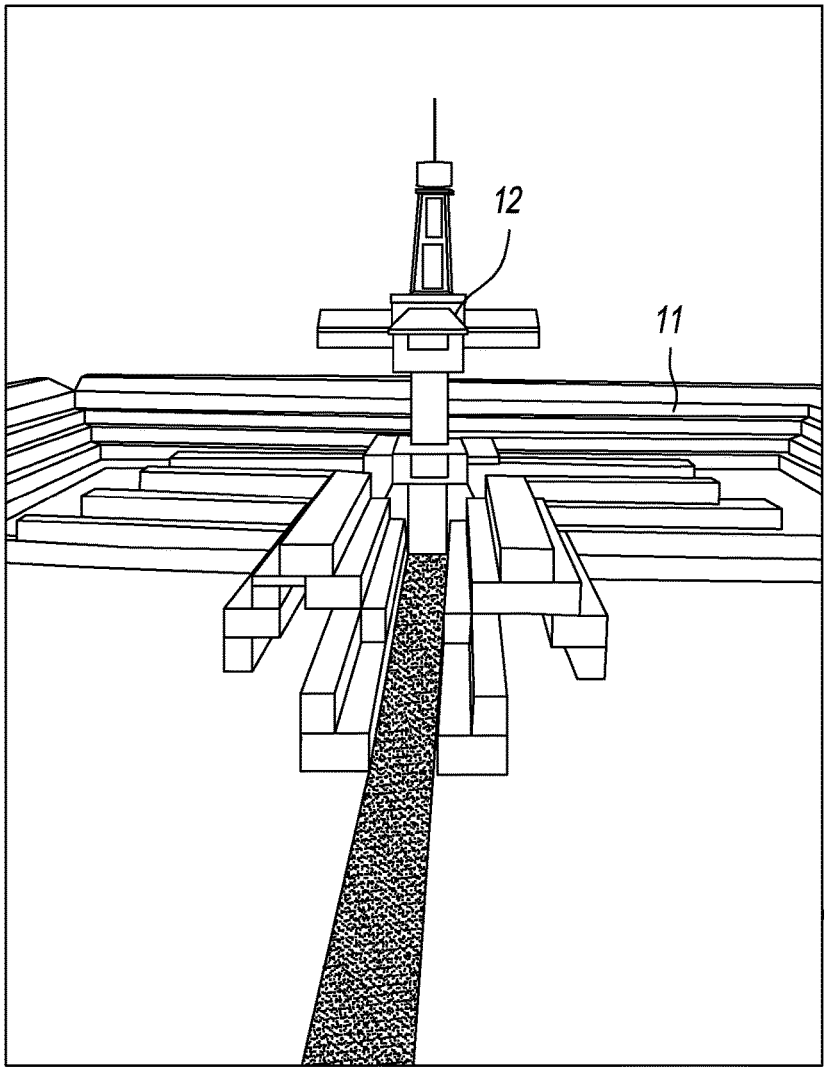

FIG. 3 is a diagram showing a close-up of a stadium. At the center of the stadium is unifying structure 12, and extending away from this structure are inner transforming bleachers 10 and dragstrip 9 and return lane 8. Around the unifying structure 12 are six areas, a grass field 1, a sand and water area 2, a dirt field 3, a concrete pad 4, and dirt field and concrete pad extension areas 6, 7 respectively. A racetrack 5 surrounds these six areas and outer bleachers 11 surround the racetrack 5. FIGS. 1 and 2 are diagrams showing a unified stadium structure 100 and an overview of a stadium 101. FIG. 1 shows walkways 13 between the inner bleachers 10. FIGS. 4-12 are photographs of a model of one embodiment of a multiple use stadium structure.

A new multiple use stadium in one embodiment is in the shape of a square cut into a cross with stands surrounding it. In that embodiment, the stadium may include four different fields, racetracks, and a unifying structure in the center of the stadium. The fields may be primarily grass, dirt, sand and water, and a unique concrete pad. However, the type of field can vary and for instance there could be two dirt fields and no grass field if desired. In one embodiment, the racetracks include a drag strip, a dirt track, and an outer track with the potential for an event such as NASCAR, as well as an Indy track with turns much like a Formula One-Indy track. In one embodiment, the unifying structure is set in the center of the fields, has optimal views of all events, and rises above the fields, as well as the inner bleachers.

The new multiple use stadium has many advantages over other stadiums. Combining single sports into one stadium makes them all stronger on a whole, especially in terms of profit. For example, maybe 20,000 people will come for a soccer game and 20,000 for a dirt bike race, equaling 40,000. But due to these events being held simultaneously, 50,000 people may show up, the reason being the greater draw from multiple events. This causes this structure to have better profit margins.

Holding multiple events simultaneously and/or consecutively also has the advantages that tickets can be sold to multiple events at once. Multiple tickets can be sold at once through a bridge system on inner bleachers as spectators cross between different events. The bridge system on the inner bleachers allows you to sell more tickets, by allowing attendees the ability to go to another event by simply walking to the next set of bleachers. Existing stadiums are deficient in that it is difficult to access a sporting event of an extremely different nature, whereas in the new multiple use stadium one can leisurely get to the next event.

The new multiple use stadium is advantageous in that it is unified. A lack of unity in other stadiums causes a lot of stadiums to be built in different places, thus causing real estate prices for the structures to go up in the long run. If there is one parking lot at each of six stadiums that is a total of six different parking lots in different places, which would cause the real estate prices to go up. This compared to having everything in one place.

For instance, the NASCAR tracks of today all have huge parking lots, which are only full twice a year. If a number of stadiums are unified in one giant stadium, then this parking lot is used more, thus causing a greater use of an investment. The money spent on the parking lot and real estate for the stadium is overall much less, because you do not have a parking lot for the dragstrip as well as a parking lot for all the other types of stadiums etc. Instead there is one giant stadium that accommodates all events.

Another advantage that this design has over others is that it offers better multiple viewing options than any other stadium. A man sitting on the top of the unifying structure can watch in one embodiment six events at once, a drag race, a nascar race, a baseball game, a skateboard competition, a dirtbike race, and a boat race. This number greatly exceeds what any other stadium can do. Not only can this person watch the most events but every one else in the stadium has access to watching many things that other stadiums cannot offer as well.

One new multiple use stadium is an alternative to three or more separate fields. A point of the new stadium is not to fit the most fields in a stadium but to provide the most unity in the stadium, in order to provide what is best for viewer options. A roof can also be put over the stadium and could result in the largest indoor arena.

Another advantage of the new multiple use stadium is that less people need to be hired to set up and change the stadium. In this stadium, there can be one elite team that can set up for all the different sports and transform the stadium in different ways, which cuts costs by being able to hire one elite force instead of hiring six different teams to do the same job.

The new multiple use stadium is an improvement over other stadiums such as Daytona International Speedway in that in one embodiment it has complete infield usage. The new stadium is a multiple simultaneously viewed stadium. The infield of Daytona is used for some sporting events and some viewing of the racetracks but it is also used for many other nonsporting nonviewing events as well.

The reason that the new multiple use stadium has complete field usage is due to the fact that it recognizes and takes advantage of the fact that the vast majority of sporting events use fields made of right angles. This is a key concept and development that this design has over other designs. By lining up the fields based on their right angles not only do you come up with a design that has complete infield usage, but also you come up with a design with a central viewing point of all sporting events. Daytona may have a setup where one can watch multiple events at once, but they do not have complete infield usage for either sporting or spectating, nor do they have a central hierarchical viewing point, all caused by the aligning of the right angles.

Lining up the 90 degree angles that the vast majority of today's sport fields require provides a big advantage. The sports fields of today are combined in the new stadium using their similar angles. The shapes of sports fields today makes it much easier to line them up then if they were all octagons for instance. The design is most important and not the type of fields. All of the fields could be grass without a track and still fall into this design. It is all about the right angles, the complete use of space for viewing events, and the central viewing point. In fact, the central bleachers are not necessary as long as there is the aligning of the fields and a central viewing point.

Diversity is a key to stadium success. Being able to stage many different kinds of events protects a facility from the changing fortunes of various sporting organizations, changing public interests and tastes, changing demographics, etc., that cause certain types of events to become less popular and certain kinds to become more popular over time. Diversity also allows a constant revenue stream to be maintained throughout the year and for a stadium design to achieve success in different areas of the world. The new stadium design allows for unprecedented diversity at minimal cost.

This is accomplished by recognizing that many sporting and other events are held in rectangular fields or areas. Because of the right angles of the rectangles, multiple rectangular fields can be aligned with one another without any wasted space between them. This allows for numerous different fields to be accommodated together within one reasonably sized space, making it possible for spectators to view some or all of these fields simultaneously. This is the most practical and efficient way to consolidate multiple fields into a single stadium. These fields or areas may also in certain circumstances be interchangeable.

In one embodiment, the general layout of the stadium is in a cross formation surrounded by bleachers with a unifying structure in the middle. From the aerial view, the structure will resemble a cross, which in one embodiment consists of three walkways and a drag strip. The three walkways start outside the stadium, have a tunnel under the racetrack, and meet at the center unifying structure. Alternatively to tunnels, bridges can be used. The fourth segment of the cross is the drag strip. This may, for example, be a half-mile drag strip. This crosses a surrounding track, also known as the outer track, and continues out of the surrounding stadium. In all four corners of the cross is a different field.

The surrounding stadium includes the normal facilities, including concessions, restrooms, ticket takers, ticket sales, etc. The surrounding stadium structure is advantageous in providing ready access to such facilities to patrons in any area of the stadium, in limiting entrance to and egress from the stadium, in directing and smoothing the flow of walking traffic throughout the stadium, for security reasons, and for ease of constructing and accessing large bleacher areas.

Where the drag strip meets the racetrack is between two corners of the outer track, and lies flat. There is either a gap in the bleachers, or the bleachers are on hinges so as to let the drag cars out without problems. Another reason to place bleachers on hinges is so that they can be put back to the outer track, for optimal viewing of outer track races. There is also adequate room given for the dragsters. In the four center corners of the cross are four fields. Surrounding the four fields and drag track is a circular racetrack, also known as the outer track. This track in a preferred embodiment goes around the four fields tightly so that the bleachers on the outside of the track are still close to the events of the four fields. In one embodiment the racetrack is also extended, past the fields, to for example the quarter mile point of the drag strip. This gives more room for pit areas, different race options for other tracks, and long straightaways for the outer track races. On the infield of the stadium alongside the fields and drag strip are transforming bleachers. These have the ability to fold in, for line of sight. In the center of the four fields and at the base of the drag strip is a unifying structure.

The first field that can be in the structure is a grass field. The grass field is primarily used for events like football, baseball, soccer, concerts, and events that go on a grass field. The bleachers surrounding the grass field in one embodiment have three settings. The first setting is a 'completely flat' and tucked away setting. The second setting is that of a tapered setting, for average sized events. The third setting is completely raised, to accommodate larger events such as the Super Bowl and the Major League Baseball championships. These bleacher settings are not necessarily unique to the grass field. The bleachers will be discussed in more detail.

The second field that can be in the structure is a dirt field. This field is primarily used for events such as monster truck rallies, dirt bike races, tractor pulls, and generally any event that would go on a dirt field. The dirt field also has the ability to expand, and serve as a racetrack. Due to the fact that there are dirt races which require more space than a field, more space is necessary for these races. Due to the fact that the drag strip will extend past the fields, thus giving extra space, a good place to put the dirt field is on one side of the drag strip. An extra set of transforming bleachers may be installed at the third side of the dirt field. When lowered this extends the dirt field thus accommodating dirt races where a larger space is needed. This increases the functionality of this area.

The third field that can be in the structure is more of a sand and water area. The Sand and water area accommodates water and land events. This venue is a giant pool filled with sand, where the water level may be raised or lowered depending on the events needed. This area also has a portable wave generator, for example of the plunger design for easy access and easy installation as well as removal This is very interesting and very fun for attendees and participants in events such as jet ski racing and even surfing. On the outside edge of the pool is Plexiglas or another height extender, that will extend upward, or simply be installed, for increased water height. This also allows for the height of the waves, so as to not have water leave the area.

The wave generator in the sand field makes for good jet ski races and even surfing. A plunger type of wave generator is advantageous because of removability. Other generators are too big and are solid structures. Also, extensions put on the height of the sandpit when the waves start prevent water from going over the sides and being lost.

Under the sand in the pool is a sump system. This serves to pump water in and out of the pool area. Outside the stadium are giant storage tanks to store the water. When dry, and completely pumped out of water the same area will be able to accommodate concerts, dirt bike races etc. Dunes may also be built for different races etc. Another option for the sand is to just let enough water in to wet the surface. This allows for wet sand races. This area can freeze or at least be able to handle freezing without complications to accommodate ice sports or events such as hockey and ice skating.

One way to build this area is to build a giant pool with a Sand proof sump in the deep end of the pool. For events such as races that could be damaged by the sand, a removable sand cover such as a hard interlocking surface, for example plastic, is made and put over it, much like the way they cover the ice of ice rinks for basketball games.

Figure 18:
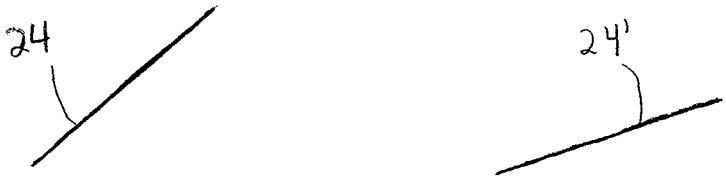
FIG. 18 is a side view diagram illustrating a concrete pad raised and lowered.

The fourth field that can be in the structure is made of concrete. This concrete reinforced pad 24 may be on hinges and have the ability to raise 24 and lower 24' as shown in FIG. 18. The raising allows for inverted races like dirt bike hill climbs. One example of how this could be done is a worm gear. The worm gear turns and then raises the concrete pad to the desired angle. For every foot on the x and y-axis there is an insert hole 25 (see FIG. 2) where an attachment to the concrete pad can be inserted. There are also dummy studs to cover these holes. An example of an attachment is skateboard ramps. Attachments can be inserted into the concrete pad, locked in place, and the structure raised, resulting in an inverted skateboarding park. The pad does not need to be raised and can stay flat for events such as tennis etc.

The concrete pad can be used for skateboarding events, tennis, wall climbing, and concerts. For concerts, all the fields can be used as one combined concert area with interior bleachers lowered (if possible) for improved visibility. For accommodating music festivals, the bleacher setting used can be similar to that for Nascar races, with the interior bleachers completely lowered and flat, and with a stage in the back center of the interior area, or with different stages spaced apart. For large music festivals, all the areas for holding events can be used together as one large area.

The concrete pad is unique in that it is used to compliment other events. In one embodiment the concrete pad is located to one side of the drag strip and serves as the pit area for the dragsters. Due to the drag strip extending past the concrete pad and thus giving extra space, this area serves as the pit area for the track race cars as well. The concrete pad serves as a multi-function area itself.

In one embodiment, the drag strip extends away from the unifying structure in a straight line for the distance required by the NHRA, or for example one half mile. At about the quarter-mile mark there is an opening in the bleachers to allow cars to pass through. Alongside the track there is a return lane for vehicles to return to the pit area. The concrete pad serves as the pit area for the dragsters. The bleachers surrounding the concrete pad transform and lower into the ground thus making access to the drag strip easier. Where the drag strip crosses the outer track is flat, so as to not interfere with the drag cars.

In one stadium embodiment with a drag strip, the stadium is square and opened on one end to allow the dragsters to pass through. There are stands on the back side of this to allow for the complete viewing of the dragsters. In an alternative embodiment, the fourth wall that the dragsters would pass through is completely disregarded and the race track is longer and extended away from the unifying structure, making the stadium rectangular in shape. The dragster still crosses the race track, just not as close to the unifying structure. This makes the track bigger, and there is more seating to surround the track. On the other side where the concrete is, is the pit area, and due to all this room this is adequate. Due to the dirt field being on one side of the drag strip, and the extra space given, the extra space can be used for dirt cart races which require more space.

In this alternative embodiment, the unifying structure is not in the center of the stadium and there are 3 walls on the dirt field and the concrete wall. This embodiment is visually appealing. Also there can be transforming fourth wall bleachers, which work because on race day all the bleachers are lowered anyway. This gives it the feel of "one stadium" as well as increasing the size, which may be necessary for NASCAR.

In one embodiment there is a racetrack, but no dragstrip separate from the racetrack. Instead, the racetrack is long enough that the dragsters can run on the out side track. Where there is a separate drag strip, the dragsters in one embodiment return on the racetrack itself rather than on a separate return lane. This works on a flat track like the Pocono Racetrack. Pit road in one embodiment is on a dirt field area as a paved area that gets covered up with dirt and in another embodiment is underground.

The dragstrip can also be used as a runway. This can either be just to launch one plane, to start an airshow similar to a flyover for a large event, or to have a place for planes and such to take off and land on for an airshow in the stadium. An airshow in the stadium would be an added attraction. The concrete pad can also be used as a helicopter take off and landing zone. In this embodiment, the center dividers on the dragstrip are removable to allow for the usage of planes. In this embodiment the bleachers have enough room for the planes as well and all bleachers in the area are lowered for safety.

A fighter jet taking off for a major event such as a NASCAR race would be great for promotion of the stadium and could be used as the start of a demo of the stadium to be released on the Internet, etc. A fighter jet taking off and once in the air doing a few loops over the stadium would generate initial excitement from the audience, as well as draw initial interest.

There can be different types of racetracks in this structure. The first is an outer track. The outer track or circular track circles the entire structure closely. This outer track does not necessarily encircle the entire drag strip and a flat area in the track can serve as a crossroad for the dragsters. The track may for example have four corners and either be square or rectangular in shape. In the corners 26 of the track (see FIG. 2) the track can be sharply banked to keep the outer bleachers seats close to the inner fields, thus increasing visibility for the attendees. The concrete pad and the area between the track and drag strip, past the concrete pad, serve as the pit areas during the bigger races. For the racetrack there is an ability to lower all the inner bleachers for optimal line of sight across the entire structure during a race. Some advantages of this include safety and complete infield access for race support.

The next racetrack is an Indy type racetrack. In order to convert the structure to accommodate Indy car-like turns, certain fields are temporarily paved or the pavement will merely have to be covered by the dirt etc. The next racetrack that can be in this structure is a dirt track. In one embodiment, the dirt field has transforming bleachers on three sides. The side furthest from the unifying structure transforms and folds into the ground to increase the size of the dirt field. The dirt field increases due to the space given between the drag strip in the outer track past the dirt field. This allows for adequate room for a dirt track race where extra space is necessary.

Figure 13:
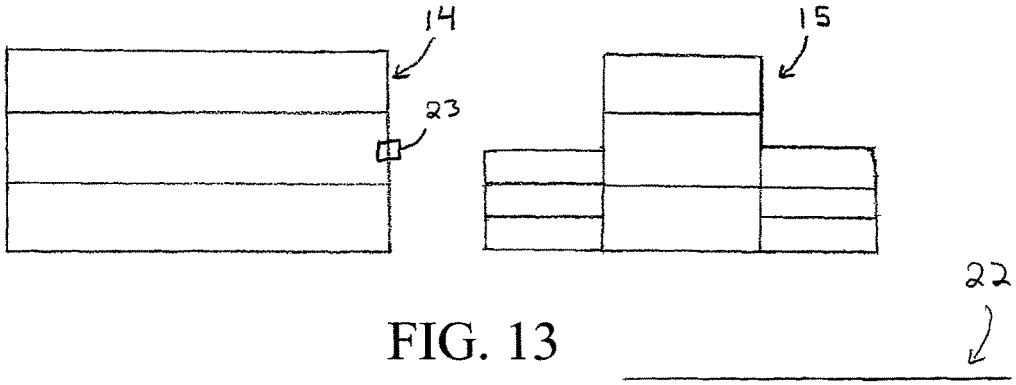
FIG. 13 is a front view diagram illustrating transformable bleachers in three positions.

Another aspect of the stadium is the bleacher system and optimal viewing. One of the best aspects to this structure's design is the ability to view multiple events at once. This is greatly due to the bleacher system in this structure in one embodiment. On the outside of the outer track are tiered bleachers. These bleachers allow for more seating, and also are designed so that attendees are able to see across the entire structure. The outer seating has a certain appeal, due to the fact that the further away you are from the outer track, the greater your view of other sporting events at this structure. At the corner of the grass and Sand area, outer bleachers rise into a point for optimal viewing. The inner bleachers may be transforming bleachers, illustrated in FIG. 13. There are three settings for these. These settings are, in ground 22, tapered 15, and completely extended 14. Locking structure 23 may be used to lock sets of mobile transformable bleachers together safely to create a seamless bleacher structure.

The first setting, or in ground, consists of the bleachers being folded back and mechanically lowered into the ground. One way that this can be done is to have them fold in, much like the common foldout bleachers in high school auditoriums. Once folded an underground hydraulic system will then lower them until level with the ground. The tops of the bleachers are flat and allow for a complete covering of the trench in which the bleachers are stored. This allows for traffic on foot as well as vehicle traffic to cross the trench area safely. A flat piece of metal can be swung over these to cover the bleachers and the trench to reduce damage as well as increase safety. This may be used as a safety measure during the other bleacher settings as well.

The next bleachers setting, or tapered setting, has the bleachers coming from a high point in the center to a low point. The high point in the bleachers is closer to the unifying structure and slowly taper down toward the outer track. This tapering allows for attendees in the outer bleachers to be able to view more events at once. This is due to the fact that the inner bleachers won't block as much of the view of attendees in the outer bleachers. In order for the bleachers to be brought out into a tapering manner and be efficient they are able to be mobile. In one embodiment they are put on tracks to bring them closer to the field. If this is not done then the low points in the Taper design are a considerable distance from the event. By bringing them from the holding trenches to the field, the people in the inner bleacher seating have better views of the events.

One problem with the design of the transforming stadium bleachers and them being tapered is that if they are all in one straight trench then the bleachers go further away from the field as they taper. The reason they do this is because they will not have to be pulled out as far, due to their height. One solution is to have them be on a track system thus giving them mobility. This allows the bleachers to be moved in toward the fields, and makes it so there will only be one trench. Also there is a piece of metal on hydraulics that covers the trench for safety reasons, to avoid a giant uncovered trench.

This also plays a role in the seating design for the grass field. If the grass fields bleachers have three settings, down flat, tapered away from the middle, and all the way up, then there needs to be a way to separate the bleachers in the middle in order to bring them to the field when there is a need for the tapered setting.

The third setting, all the way up, is for large events that require more seating. An example would be, for instance, a Super Bowl. For this type of event all of the seating rises out of the trench, much like the Tapered seating. The difference is that there is no tapering. The fields surrounded by bleachers in the fully extended position have more of a modern-day stadium look to them. This gives a greater audience to a single field. In order to have both the tapered and the fully extended bleacher seating compatible with each other, there can be a way to unlock and lock the bleachers at their tapering points. This allows for the mobility of the bleachers in the tapered setting (to bring them closer to an event) and also the ability to lock them together, if necessary for the fully extended, as well as the in the ground settings. This is primarily for safety, as well as a functioning design.

These transformable bleachers are perfect for the curves of a track due to the high banks necessary to get the audience close to the inner fields as well as accommodate a super-speedway.

In one embodiment, a racetrack in the stadium structure has sharp turns in order for the bleachers on the outside of the track to have a good view of the track. In order for race cars to maintain their speed around these sharp turns, the turns can be made to have hard banking. In one embodiment there are walls around the track and the track is flat like the track at the Pocono Raceway. On days when there is no race, bleachers can be installed on the flat track that taper to the fields, thus giving the stadium optimum seating. Basically the whole racetrack is replaced with bleachers, providing more seating and thus more tickets to sell.

In one embodiment, the general layout of the bleachers is as follows. On the outside of the outer track are the outer bleachers. These surround the outer track. On the inside of the outer track are the transforming bleachers. These run away from the unifying structure in a straight line parallel to the walkways and drag strip facing the fields. Due to a possible increase in the space away from the unifying structure next to the potential location for the dirt and concrete pad, a set of transforming bleachers are installed. These serve to better accommodate the dirt and concrete area.

In one embodiment, a single banked turn where the grass and sand fields are located by the end of the dragstrip causes a slingshot effect, thus allowing the cars to reach higher speeds and resulting in a super speedway.

Where the outer bleacher meet the inner ones there is a "blind spot" as far as seeing the fields goes. This "blind" area could be used for things such as concessions.

It is advantageous for the outer bleachers to be raisable for different sports because in different events restrictions on how close viewers can be, as well as obstructions, result in a need for different heights. For instance the jersey wall on the race track requires the outer bleachers to raise higher to see over them. Also the distance between the jersey wall and the bleachers is greater than for other sports so this is taken into consideration when looking for the best possible viewing angles.

In one embodiment, the outer bleachers are transformable and high enough around the racetrack that a set of removable bleachers can match the angle of the outer bleachers and thus bring bleachers over the track and if need be the infield to have an audience come in closer. This combines with transforming outer bleachers and matches them more easily when they raise. The higher the outer bleachers raise the smaller the infield will become due to it being covered by seating matching the angle (the removable bleachers will extend out over the fields themselves). Therefore a smaller infield means more seating, closer viewing and perfect size fields for sports that require it, such as basketball.

Figure 16:
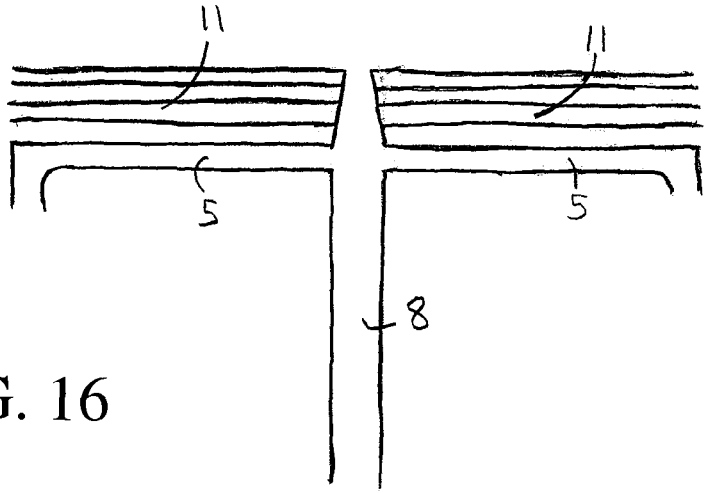
FIG. 16 is a top view diagram illustrating a gap in racetrack viewing areas to allow passage of vehicles from the dragstrip.
Figure 17:
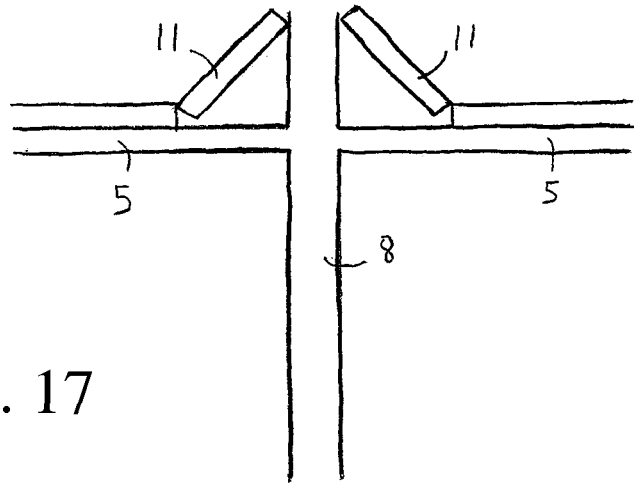
FIG. 17 is a top view diagram illustrating hinged bleachers rotated away from a racetrack.

Along the drag strip is a set of bleachers on the side of the dirt extending the length of the dirt field bleachers or longer. The dirt and drag strip bleachers sit back to back, resembling a pyramid. These also transform. Across from these bleachers and across the dragstrip is the return lane. Past this are the bleachers for the concrete pad. At the meeting point between the drag strip and outer track, the outer bleachers are either on hinges and swing out for dragsters to cross (as shown in FIG. 17), or just have a V cut in them to allow dragsters out of the structure (as shown in FIG. 16).

Figure 14:
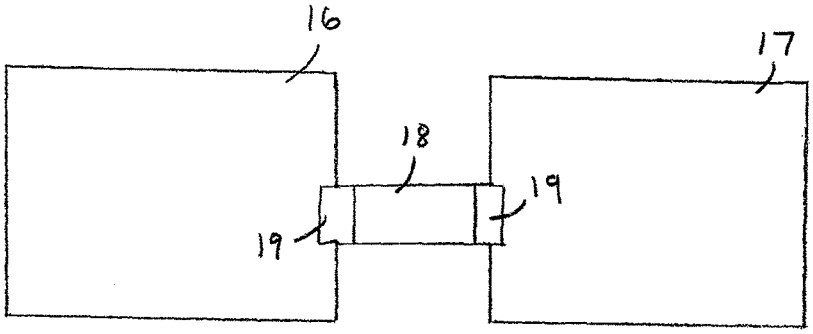
FIG. 14 is a top view diagram illustrating a bridge structure between spectator areas and electronic ticket gates.

The inner bleachers may be connected via bridges 18 at the top, illustrated in FIG. 14. These most likely resemble a drawbridge and are located close to the unifying structures to allow for crossing between venues during the tapered setting. In the fully extended position there are two bridges, one close to the unifying structure and one away from it. These bridges not only serve as paths to other events 16, 17, but they also serve as a way to generate more revenue. On these bridges ticket collectors or electronic ticket gates 19 can be located. These serve to generate more income by having the ability to charge for the viewing of other events. Alternatively, the bridges can be set up to allow spectators to cross without obstruction or payment, or can be set up to allow spectators to pass after their valid admission to the stadium has been verified.

The inner bleachers can also have private box seating at the top of them. These may be offset like a defense structure typically seen on the top of castle walls. This allows for the attendees in these boxes to see past one another and view more events at once.

In one embodiment, a unifying structure is in the center of the four fields and drag strip. The central structure does not have to be in the dead center of the stadium structure in all embodiments, for example with certain racetracks. It is preferable placed in the area for the best views, closest to the action. In one embodiment, there are several unifying structures in the infield of a track. This is especially advantageous with a track where there are several turns spaced away from each other, where a unifying structure can be put in each corner. For other embodiments, particularly with bigger tracks, there can be two unifying structures at each end.

Figure 15:
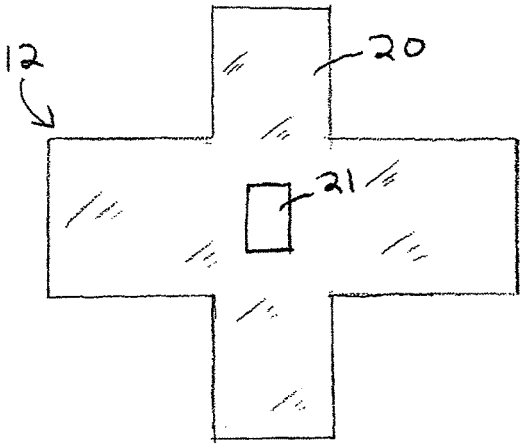
FIG. 15 is a top, interior view diagram of a unifying structure.

The unifying structure in one embodiment looks similar, but not exactly like, the Seattle space needle. This rises above the inner bleachers. From an aerial view straight down upon the unifying structure, it resembles a cross, an embodiment of which is illustrated in FIG. 15. The points extend out over the walkways for optimal viewing of the fields. The point over the drag strip has less tapering and is flat at its end for viewing of the drag strip. The glass in the unifying structure is tapered so that the bleachers inside will be able to see down from the unified structure with more ease. The floors 20 may also be transparent as illustrated in FIG. 15 for better viewing. Alternatively, there may be spectator boxes in the bottom of the space needle instead of transparent flooring to increase revenues.

In the center of the unifying structures in one embodiment are bars and clubs 21. The entire structure is climate controlled from a heating and cooling building outside the stadium. Hot or cold water is pumped in to this structure. The reason for this is to allow the roof of the unified structure to be flat and free of heating and cooling units. Attendees are able to walk around the roof, which is flat, and watch multiple events at once. In the top center of the unified structure is a shaft that runs out of the center and straight up. At the top of this is either a one-person pad or a private box seating. This is the most prized seating for one can see whatever event they want by simply moving their head. This gives attendees more viewing options than ever before in event structure history. From this place, the attendee will be able to see every event.

One embodiment of the central unifying structure, instead of inner bleachers, has a condominium structure with full balconies. This structure serves as the VIP seating and removes the need for a walkway, thus utilizing more of the infield space for events and viewing. In fact this condo may be in the shape of a cross and sit in the center overtop the walkway. In one embodiment this structure sits atop posts much like beach houses in order to let any sort of traffic pass underneath. The central viewing post still sits in the center to allow for the best view. This condo in one embodiment is tapered to allow for better outside bleacher viewing. The top of the hotel is flat in one embodiment and used for viewing or for a bar or club. The hotel may have an electronic pay bridge across the track to the outer bleachers.

An alternative embodiment of the central unifying structure that is cheap and cost effective is a portable structure that is transportable. It may be round like the Epcot center or like a radar dish and can be torn down and set back up with relative ease like the setup for a typical concert. This portable structure can travel with the racers from track to track and be set up and torn down for every race, if necessary.

The central structure could be used in existing racetracks and in one embodiment is a round hotel or even a hotel that matches the inner circumference of existing tracks, thus giving the most surface area for viewing and using all of the available space.

In one embodiment, a glass globe object is used for the central unifying structure and spins at the pace of the cars and is filled with bleachers. The glass in this structure can change angles so the person in the best seat could see out of the glass the best. Alternatively, in one embodiment there is no glass at all, only bleachers and guard rails.

Instead of just a stationary space needle, in one embodiment the central unifying structure has a rotating design. An example of this is something that very closely resembles a radar atop boats spinning. This gives the people spinning in the bleachers a constant view of the car that they wish to see. For instance if the people in the stands want to watch the lead car the whole time they can lock on to the radio signal coming from the car desired and turn with it, thus viewing the lead car during the whole race. This is good for team owners.

For the unifying structure, in one embodiment there is some sort of cooling system outside of the tower itself. Most AC units are on the tops of buildings and that does not work well with this design. No one is going to want to be on the top of the needle with a bunch of cooling and heating equipment. Instead, the cooling and heating can come in from water pipes like in a base board system. Insulated lines are run to the tower from a cooling/heating building outside of the stadium, and then water is pumped in to the space unifying structure.

The event structure has accompanying structures to the main structure. In one embodiment, one such structure is the heating and cooling building. This is located away from the stadium preferably in the direction that the wind blows towards. This is to keep the stadium from encountering much of the heat and noise generated in this building. This building is used to supply whatever heating and cooling needs the building and overall structure has. This building also houses any other sort of apparatus that doesn't have to be in the event structure itself.

In one embodiment, the stadium may have another structure. This structure is a building that houses equipment to make mechanical devices, from raw materials. These include, but are not limited to, machine shops, wood shops, plastic and epoxy shops, aerodynamics shops, wind tunnels etc. This structure is underneath the structure, attached to the structure, or at least within walking distance. The entire structure serves not only as entertainment, but is the first structure to unify a stadium with new ideas and inventions. Due to all of the different events capable in this single structure, new ideas will form here and be able to be tried at this location due to this building. This building has trained personnel, and functions much like a library in the idea of free check out. Anyone is able to use the machines for free. Along with this building is a patent attorney's office, in order to help users retain their rights as soon as possible. This is to encourage use of this facility and the birth of new ideas at this structure.

In some embodiments, the stadium has a removable tent-type top. The top is held up on the corners of the stadium by a supporting structure and then attached by cables to giant winches in the ground that pull the top up. This leaves the roof with a flat top that does not shed rain well, so additional cables are inserted in the center in one embodiment and the supporting structure system is set higher to pull up the top in the middle, thus giving the top an arch that enables it to shed water.

The invention is not limited to the particular embodiments illustrated in the drawings and described above in detail. Those skilled in the art will recognize that other arrangements could be devised, for example, various configurations of bleachers, fields, walkways, and racetracks.

While the invention has been described with reference to specific embodiments, modifications and variations of the invention may be constructed without departing from the scope of the invention.

I claim:

1. A stadium structure, comprising:

plural distinct areas for holding events to be viewed by spectators, one or more areas for spectators to view events, and a surrounding structure enclosing the areas for holding events and areas for spectators to view events, wherein multiple events to be viewed by spectators can be held simultaneously, wherein the one or more areas for spectators to view events comprises one or more sets of transformable bleachers, wherein the transformable bleachers can be moved between at least two different positions, wherein one of the at least two different positions of the transformable bleachers is a tapered position in which the slope of the transformable bleachers is steeper at one point along their length than at another point along their length, whereby the maximum lengthwise cross-sectional area of the bleachers is reduced, reducing the obstruction of the view of spectators not seated in but facing the transformable bleachers.

2. The stadium structure of claim 1, wherein the transformable bleachers are mobile so that they may be brought closer to one or more of the areas for holding events when in the tapered position.

3. The stadium structure of claim 2, wherein the one or more sets of transformable bleachers have a locking structure, whereby they may be locked together safely to create a seamless bleacher structure and unlocked and moved closer.

4. A stadium structure, comprising:

plural distinct areas for holding events to be viewed by spectators, one or more areas for spectators to view events, and a surrounding structure enclosing the areas for holding events and areas for spectators to view events, wherein multiple events to be viewed by spectators can be held simultaneously, wherein one of the areas for spectators to view events comprises a unifying structure located between a first set of two or more of the areas for holding events, wherein the unifying structure is configured such that spectators in the unifying structure have a direct view of events being held simultaneously in the first set of two or more areas for holding events from a single position, wherein one of the plural distinct areas for holding events to be viewed by spectators is a racetrack and one of the plural distinct areas for holding events to be viewed by spectators is a drag strip, wherein the one or more areas for spectators comprise one or more racetrack viewing areas around the racetrack, wherein the one or more racetrack viewing areas comprises hinged bleachers that can be rotated on their hinges away from the racetrack to allow vehicles to pass from the drag strip outside of the racetrack viewing areas or there is a gap in the racetrack viewing areas that serves the same purpose.

* * * * *